United States Patent [19]

Freling

[11] Patent Number: 4,535,018

[45] Date of Patent: Aug. 13, 1985

[54] COMPOSITE DECORATIVE ARRANGEMENT WITH DUAL ADHESIVE CHARACTERISTICS

[75] Inventor: Martin Freling, Paramus, N.J.

[73] Assignee: Meyer Label Co., Inc., New York, N.Y.

[21] Appl. No.: 493,774

[22] Filed: May 12, 1983

[51] Int. Cl.[3] ..... B44C 1/16

[52] U.S. Cl. ..... 428/79; 428/187; 428/195

[58] Field of Search ..... 428/79, 40, 41, 42, 428/187, 195, 914

[56] References Cited

U.S. PATENT DOCUMENTS 3,925,585 12/1975 Aoyagi ..... 428/79 X 4,086,379 4/1978 Brown ..... 428/79 X

*Primary Examiner*—Henry F. Epstein

*Attorney, Agent, or Firm*—Gottlieb, Rackman and Reisman

[57] ABSTRACT

A novelty decorative arrangement is provided by a composite separable combination of a stick-on element and an iron-on element, each such element being provided with a design. The arrangement includes a substrate formed of a semi-rigid material, such as cardboard or plastic film, which is provided with a design on one surface thereof, and a tacky adhesive layer on its opposite surface. The substrate, which forms the stick-on element, is detachably coupled to a fabric element carrying another design and having a heat-responsive adhesive characteristic so as to form the iron-on element. The iron-on element protects the tacky adhesive of the stick-on element from contamination which would reduce its adhesive characteristic. In manufacture, the joined elements are cut in a single cutting operation so that each has an overall shape configuration which corresponds generally to the cumulative shape configurations of the respective designs. In some embodiments, thereof, different designs may be applied to the substrate and to the fabric element, with the designs either having similar or quite different shapes, all within the confines of the area of the overall configuration of the composite member.

14 Claims, 3 Drawing Figures

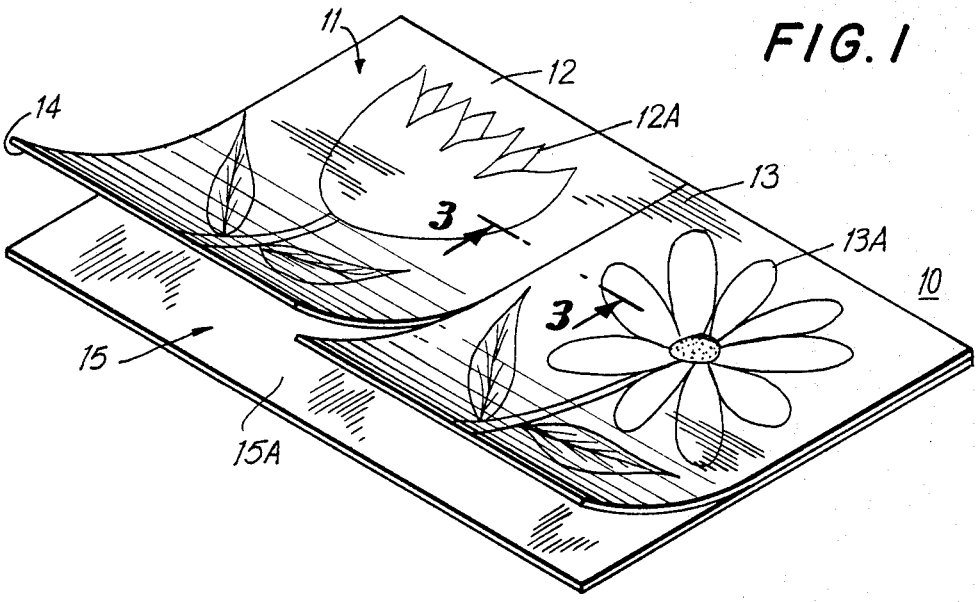
FIG. 1
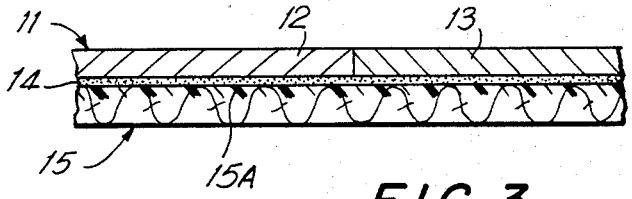
FIG. 3
FIG. 2
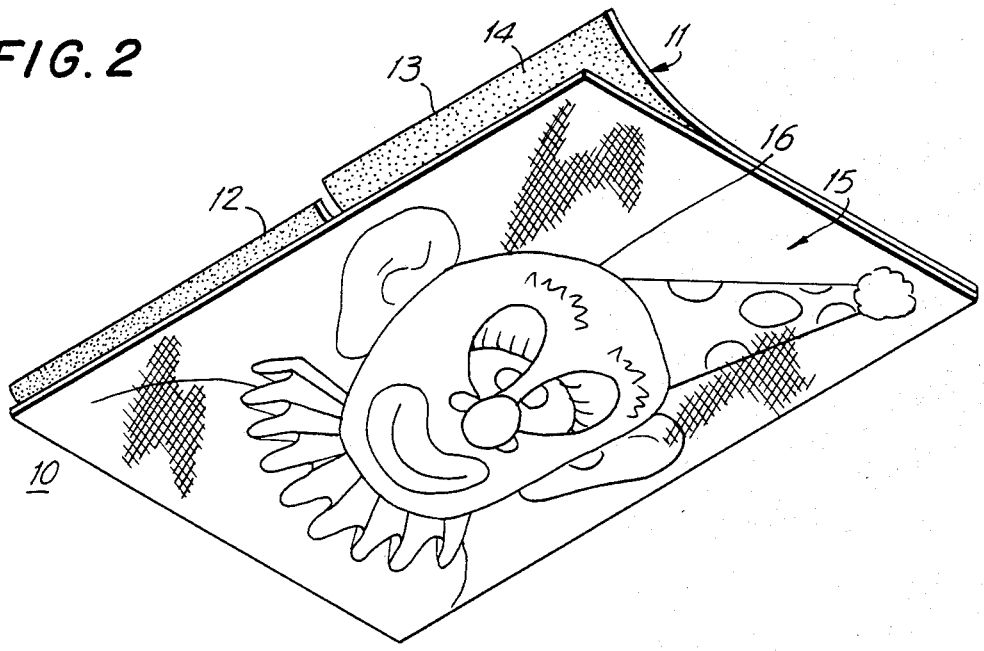

COMPOSITE DECORATIVE ARRANGEMENT WITH DUAL ADHESIVE CHARACTERISTICS

BACKGROUND OF THE INVENTION

This invention relates generally to novelty items for adhering to and decorating garments and other commodities, and more particularly, to a decorative arrangement which utilizes a composite construction of heat-responsive (commonly called iron-ons) and contact-responsive (commonly called pressure sensitive stick-ons) decorative elements.

Highly stylized and decorated garments such as T-shirts, outer shirts, jackets, and pants have been and continue to be popular. Decorated T-shirts, for example, have enjoyed substantial commercial success in younger age groups. Similarly, young persons, who are typically of high school age, and younger children, exhibit a disproportionately high interest in decorating other possessions, such as books, briefcases, bicycles, and other similar items.

A considerable market has therefore developed for decorations of the so-called "iron-on" type which, as the designation indicates, adhere to the fabric of a "soft" garment upon being subjected to the heat produced by an ordinary household iron. By this technique, relatively permanent decorations or patches can be affixed to various items of wearing apparel in such a manner as to withstand repeated laundering. The market demand for easy-to-apply decorations which can be adhered to the second or "hard" group of possessions has, on the other hand, been addressed by an industry which produces stick-ons having a decorative surface and an opposite adhesive surface. These stick-ons achieve a more transient decorative effect which is virtually instantaneous and yet can be readily removed at the whim of the user.

Interestingly, both of these "hard" and "soft" industries have grown rather independently and it is unusual to find identical decorations which match for both groups or which are in any way coordinated. Moreover, each type of decoration requires separate types of protection to the point of sale, e.g., envelopes for the "iron-ons" and wax type "release" paper for "stick-ons". The generally disposable nature of the protective release material for pressure sensitive stick-ons offers a design opportunity to combine two different but related items into one. But heretofore, the two types of decorations have acquired separate markets, technologies and sales approaches. Certainly, little or no attention has been paid to the characteristics which these items have in common, and how these mutual features might be used to good advantage in developing a dual purpose and function composite decorative element.

It is therefore an object of this invention to provide iron-ons and stick-on decorative elements for applying designs conveniently and inexpensively in a composite structure.

It is a further object of this invention to provide iron-ons and stick-ons as a single unit to thereby furnish a usuable protective liner for the stick-ons which reduces the waste element, and delivers to a recipient a dual end product.

It is another object of this invention to furnish a combined iron-on/stick-on which simplifies and reduces the cost of manufacturing and packaging iron-on and stick-on decorative elements for applying designs by eliminating the need to manufacture each item separately.

SUMMARY OF THE INVENTION

The foregoing and other objects of the invention are simply achieved by the unorthodox combination of an iron-on and stick-on, with the iron-on forming protection for the stick-on and causing a synergistic elimination of the otherwise necessary protective disposable layer. According to the invention, the iron-on vehicle and the stick-on vehicle are joined to each other by the adhesive layer on the substrate of the stick-on. The joining is of the nature where the substrate and the fabric can be readily separated from one another, but the adhesive layer remains on the substrate and does not transfer to the iron-on vehicle. Thus, the removable iron-on, in the form of a fabric or non-woven cellulosic material, acts as the protective element for the adhesive layer of the stick-on, and exposes the adhesive when removed therefrom.

In one embodiment of the invention, the designs which are carried by the stick-on and iron-on elements may be identical in size and shape with respect to each other, and may even be mirror-image representations of each other. When the designs are thus registrable, only a single cutting operation is required to cut both vehicles to a shape which corresponds to the configuration of the design. (Of course, the vehicles may be thus cut together in one cutting operation without the need for registering the designs, if sufficient area is left thereon to accommodate manufacturing tolerances.)

The semi-rigid material which forms the substrate of the stick-on element may illustratively be formed of cardboard or paper. In this regard, the only requirement is that the substrate material have sufficient tensile strength to permit its separation from the iron-on vehicle being torn. In other embodiments, the substrate may illustratively be formed of a translucent or transparent plastic film or it may also be made of a rigid material which, however, may not generally adhere lastingly to a flexible surface.

As indicated, the fabric of the iron-on vehicle should preferably have a heat-sensitive adhesive characteristic, which can be activated by the application of localized heat such as that provided by an ordinary household iron.

BRIEF DESCRIPTION OF THE DRAWINGS

Comprehension of the invention is facilitated by reading the following detailed description in conjunction with the annexed drawings, in which:

FIG. 1 is an isometric representation of an embodiment of the invention showing multiple "stick-on" designs deposited on a substrate;

FIG. 2 is an isometric representation of an embodiment of the invention showing a different design deposited on an iron-on vehicle opposite said stick-on members; and FIG. 3 is a cross-sectional view of a fragmentary portion of the invention, showing he conjoining of the stick-on and iron-on elements, taken along the line 3—3 of FIG. 1 in the direction of the arrowns.

DETAILED DESCRIPTION

FIG. 1 is an isometric representation of a specific illustrative embodiment of the invention which is generally designated as 10. The decorative arrangement 10 is provided with a substrate 11 having two illustrative components 12 and 13, each with respective designs 12A and 13A applied thereto. This figure further shows a fabric 15 which is partially coupled to, and partially separated from substrate 11.

FIG. 2 is an isometric representation of the reverse surface of decorative arrangement 10, showing a design 16, which may be different from design 12A and 13A on substrate 11. Substrate 11 is provided with a tacky adhesive 14 on an inner surface thereof, which is shown in FIG. 2 to be at least partially in contact with fabric 15.

As shown in FIGS. 1 and 2, substrate 11 and fabric 15 of the illustrative embodiment are cut to have identically shaped overall configurations, which are shown to be substantially rectangular for purposes of illustration. In the manufacturing process, and preferably prior to cutting, in the congruent illustration shown, some care is taken to place designs 12A, 13A and 16 generally opposite from one another, although exact registration is not required. When the arrangement is cut from a large production sheet (not shown), a sufficient area is left surrounding the respective designs such that the lack of exact registration is accommodated.

In one embodiment of the invention, substrate 11 is formed of a semi-rigid material, such as cardboard, paper or "tag". Alternatively, the substrate may be formed of a plastic film, such as Mylar, which may be translucent or clear over respective portions thereof. Tacky adhesive 14 which is applied to one surface of the substrate is of a type which exhibits preferential adherence to the substrate. Thus, when the substrate and the fabric are separated, after having been joined, the tacky adhesive remains on the substrate.

Fabric 15 is of a type which has a heat-responsive adhesion characteristic, and may illustratively be any heat-resistant material or a non-woven cellulosic material. This fabric can be placed adjacent to a fabric of a garment or other fabric item and heated in a conventional manner using an ordinary household iron to activate heat-responsive adhesive on surface 15A, to thereby cause fabric 15 to adhere to the receiving material (not shown). During the period between manufacturing and use of the decorative arrangement, fabric 15 serves to protect tacky adhesive 14 from collecting lint, fuzz, dirt, or other contaminants which diminish its ability to adhere. This aspect of the invention eliminates the need for a separate coating on tacky adhesive 14, thereby lowering the cost of producing the decorative arrangement and reducing waste and litter and rendering the product more convenient and versatile.

FIG. 3 shows a cross-sectional presentation of the illustrative embodiment of the invention, wherein the substrate and the heat-responsive adhesive fabric contain overlapping designs. The arrangement of FIG. 3 (considered with FIGS. 1 and 2) is provided with substrate 11 having the design of flowers 12A and 13A deposited on sections 12 and 13 thereof, respectively. Heat-responsive adhesive fabric 15 is shown coupled to substrate 11 by means of adhesive layer 14. On the opposite, exposed surface of fabric element 15 is the design 16 of a clown, from which it is apparent that designs on stick on portion 11 need not be identical to designs on fabric element 15.

It should be further appreciated from FIG. 3 that substrate 11 and fabric 15 may each be cut to have a configuration which is similar to that of another design, which is common to both sides. On such an embodiment, registration between the designs on the respective elements may be used to prepare the ultimately removed design elements for application to appropriate surfaces. However, such conformity is not a prerequisite to the operation of the invention, which can be implemented with a variety of dissimilar designs on opposite sides of the composite element, as illustrated in FIGS. 1 and 2.

In actual use, it will therefore be understood that a consumer purchases the composite unit 10 of FIG. 1, consisting of substrate 11 on one side and fabric or comparable element 15 on the other. In its original condition, unit 10 consists of the two elements 11 and 15 sandwiched completely together in contiguous and superimposed fashion, thereby providing primary protection for the adhesive layer 14 of the substrate 11, while at the same time furnishing coverage of surface 15A of fabric element 15. The consumer thereupon separates the two elements and upon disassembling, creates stick-on members consisting of two elements 12 and 13 of substrate 11, with designs 12A and 13A being visible thereon, and fabric or comparable element 15 with its design 16 on that surface. The stick-on elements 12, 13 can merely be applied in conventional fashion to appropriate objects such as books, walls, vehicles and the like, while the iron-on element will be placed in contact with an appropriate fabric or garment and, upon the application of suitable heat from a source such as an iron, will firmly adhere to its application surface.

Accordingly, this invention contemplates the dual usage of a composite sandwich element, comprised of two previously independent elements which have not heretofore been utilized together and which now function to provide mutual advantages to the other element of the sandwich without interfering with the desirable features of either element.

Although the invention has been described in terms of specific embodiments and applications, persons skilled in the art, in light of this teaching, can generate additional embodiments without departing from the spirit or exceeding the scope of the claimed invention. Accordingly, the drawings and descriptions in this disclosure are proffered to facilitate comprehension of the invention and should not be construed to limit the scope thereof.

I claim:

1. A novelty decorative arrangement utilizing, in composite relation:

a substrate having a first overall configuration and having first and second sides, said substrate further having a first design on said first side thereof;

a fabric element having first and second surfaces, including a second design on said first surface and a heat-responsive adhesive on said second surface, said fabric element having a second overall configuration with dimensions at least as large as those of said first overall configuration of said substrate to initially cover said second side of said substrate; and adhesive means having a substantially tacky consistency applied to said second side of said substrate and in contact with said heat-responsive adhesive for detachably coupling said fabric element to said substrate, whereby said adhesive means remains on said substrate upon detachment of said fabric element therefrom.

2. The novelty decorative arrangement of claim 1 wherein said first overall configuration of said substrate is substantially identical to said second overall configuration of said fabric element, said first and second overall configurations registering with each other when said substrate and said fabric element are coupled together in said composite relation by said adhesive means.

3. The novelty decorative arrangement of claim 2 wherein said first and second designs are substantially identical in size and shape, and said first and second overall configurations correspond substantially to said size and shape of said first and second designs.

4. The novelty decorative arrangement of claim 2 wherein said first and second designs are dissimilar in shape and design from each other, with said first design being contained within said first overall configuration of said substrate and said second design being contained within said second overall configuration of said fabric element.

5. The novelty decorative arrangement of claim 4 wherein at least one of said first and second designs includes a plurality of design components.

6. The novelty decorative arrangement of claim 1 wherein said substrate is formed of a paper material.

7. The novelty decorative arrangement of claim 1 wherein said substrate is formed of a plastic film.

8. The novelty decorative arrangement of claim 7 wherein said substrate is translucent in preselected portions thereof.

9. The novelty decorative arrangement of claim 1 wherein said fabric element is formed of non-woven cellulosic material.

10. A novelty decorative product produced by a process comprising the steps of:

forming a composite material of a semirigid flexible material substrate with a tacky adhesive surface and a fabric element having a heat-responsive surface covering and in contact with said tacky adhesive surface;

applying a first decorative design to the exposed side of said substrate of said composite material;

applying a second decorative design to the exposed surface of the said fabric element; and separating said substrate and said fabric element to expose said tacky adhesive surface of said substrate for direct contact application purposes and to expose said heat-responsive surface for heat-assisted application purposes.

11. The process of claim 10 including the further step of cutting said joined substrate and fabric element to produce an overall shape configuration.

12. The process of claim 11 wherein the later of said applying steps includes the further step of registering one of said first or second decorative designs with the other.

13. The process of claim 10 including the further steps, subsequent to said separating step, of:

placing said fabric element adjacent to a garment; and heating said fabric element ot activate said heat-responsive surface.

14. The process of claim 10 including the further step, subsequent to said separating step, of affixing said substrate to a receiving surface by means of said tacky adhesive surface.

* * * * *